US008579647B2

(12) United States Patent
Phillips et al.

(10) Patent No.: US 8,579,647 B2
(45) Date of Patent: Nov. 12, 2013

(54) HIGH SPEED ELECTRICAL CONTACT ASSEMBLY

(75) Inventors: David A. Phillips, Cobleskill, NY (US); Heath A. Johnson, West Sand Lake, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 13/105,447

(22) Filed: May 11, 2011

(65) Prior Publication Data

US 2011/0281454 A1 Nov. 17, 2011

Related U.S. Application Data

(60) Provisional application No. 61/333,961, filed on May 12, 2010.

(51) Int. Cl.
*H01R 13/625* (2006.01)

(52) U.S. Cl.
USPC ..... 439/345

(58) Field of Classification Search
USPC ..... 439/345, 347, 589, 607.01, 357–358, 439/607.05
See application file for complete search history.

(56) References Cited

U.S. PATENT DOCUMENTS

| | | | | |
|---|---|---|---|---|
| 4,734,057 | A * | 3/1988 | Noschese | 439/589 |
| 4,762,504 | A * | 8/1988 | Michaels et al. | 439/345 |
| 4,762,505 | A * | 8/1988 | Asick et al. | 439/347 |
| 5,707,252 | A * | 1/1998 | Meszaros | 439/320 |
| 6,494,743 | B1 | 12/2002 | Lamatsch et al. | |
| 7,316,584 | B2 * | 1/2008 | Mackillop et al. | 439/607.05 |
| 2003/0199205 | A1 * | 10/2003 | Kosmala | 439/752 |

FOREIGN PATENT DOCUMENTS

| | | |
|---|---|---|
| EP | 1152498 | 11/2001 |
| FR | 2921522 | 3/2009 |

* cited by examiner

*Primary Examiner* — Jean F Duverne
(74) *Attorney, Agent, or Firm* — Blank Rome LLP

(57) ABSTRACT

A contact assembly that comprises an outer body and an insert assembly receivable in the outer body. The insert assembly includes a housing and a conductive bather received in the housing. The conductive barrier defines first and second receiving areas in the housing. At least a first contact member is receivable in the first receiving area and at least a second contact member is receivable in the second receiving area. Each of the first and second contact members is adapted to accept a conductor.

24 Claims, 8 Drawing Sheets

HIGH SPEED ELECTRICAL CONTACT ASSEMBLY

RELATED APPLICATION

This application claims priority under 35 U.S.C. §119 to U.S. Provisional Application Ser. No. 61/333,961, filed on May 12, 2010, entitled High Speed Electrical Contact Assembly.

FIELD OF THE INVENTION

The invention relates to an electrical contact assembly that accommodates high speed data transfer.

BACKGROUND OF THE INVENTION

Current connection systems require increasingly higher reliability and data speed transmission. For example, current connection systems are required to meet standards, such as IEEE 802.3. IEEE 802.3 is a collection of standards relating Ethernet, which is one of the most common computer-to-computer data communication methods. At higher speeds, however, the signal degrades due to crosstalk interference between conductors. That is particularly the case where the conductors are untwisted and terminated to a connector, such as a plug or socket.

Therefore, a need exists for a contact assembly that can accommodate high data speeds while also maintaining a size for retrofit applications in existing connection systems.

SUMMARY OF THE INVENTION

The present invention generally provides a contact assembly that comprises an outer body and an insert assembly that is receivable in the outer body. The insert assembly includes a housing and a conductive bather that is received in the housing. The conductive barrier defines first and second receiving areas in the housing. At least a first contact member is receivable in the first receiving area and at least a second contact member is receivable in the second receiving area. Each of the first and second contact members is adapted to accept a conductor. In one embodiment, the contact assembly may be a plug assembly, and in another embodiment, the contact assembly may be a socket assembly.

The present invention may also provide a contact assembly that comprises an outer body and an insert assembly that is receivable in the outer body. The insert assembly has a housing that includes first and second identical insulator halves, and a conductive barrier that is disposed between the first and second identical halves. The conductive barrier defines first and second receiving areas in the housing. A contact member is receivable in the first receiving area and is adapted to receive a conductor; and a contact member is receivable in the second receiving area and is adapted to receive a conductor.

The present invention may also provide a contact assembly that comprises an outer body and an insert assembly that is receivable in the outer body. The insert assembly includes a unitary one-piece housing with a first end and a second end opposite the first end. A conductive barrier is receivable in the housing and defines first and second receiving areas in the housing. At least a first contact member is receivable in the first receiving area of the housing; and at least a second contact member is receivable in the second receiving area of the housing, wherein each of the first and second contact members is adapted to accept a conductor.

The present invention may also provide a method for assembling a contact assembly where the contact assembly includes an outer body, first and second insulator halves, a conductive barrier, and first and second contacts. The method may include the steps of coupling the first and second halves with the conductive barrier sandwiched therebetween to create an insert assembly; sliding first and second conductors into the first and second contacts; sliding the first contact with the first conductor into a first receiving area of the insert assembly defined between the first insulator half and the barrier; and sliding the second contact with the second conductor into a second receiving area of the insert assembly defined between the second insulator half and the barrier.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
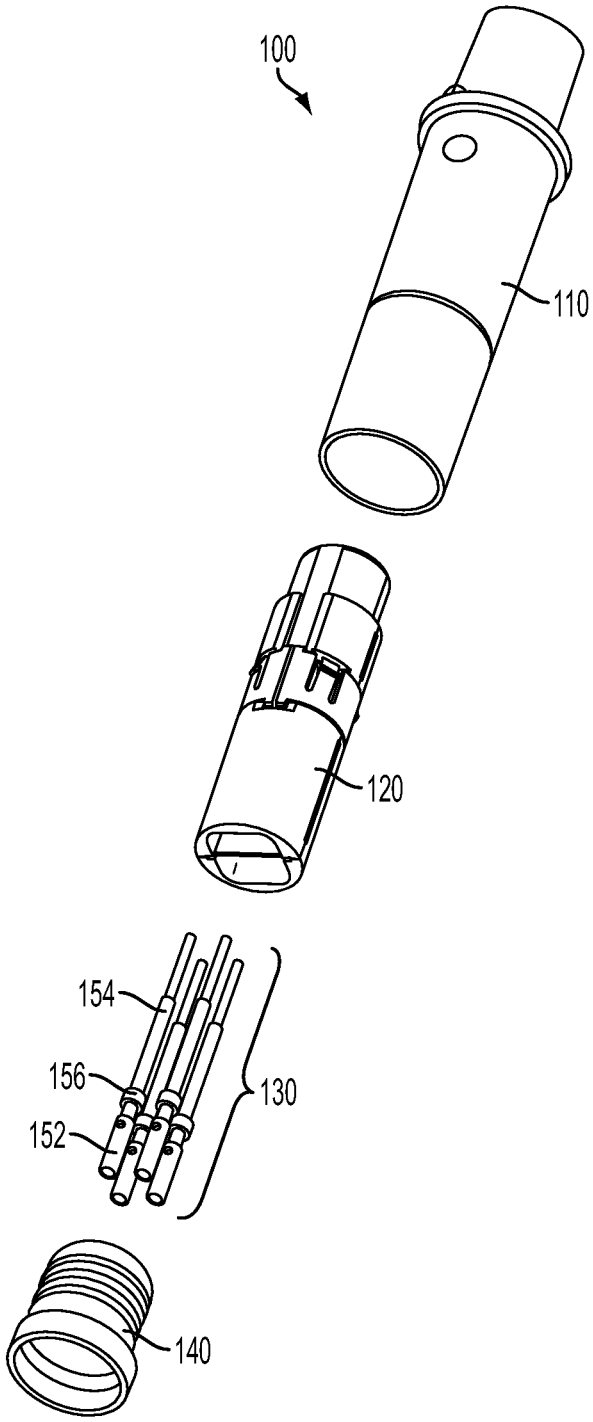
FIG. 1 is an exploded perspective view of a contact assembly according to a first embodiment of the present invention.

Referring to FIGS. 1-4, a contact assembly 100 according to an exemplary embodiment of the present invention is designed to reduce crosstalk between conductors, thereby allowing for much higher data transfer speeds than conventional contacts and connectors. The contact assembly 100 may generally include an outer body 110, an insert assembly 120, a plurality of contact members 130, and a crimp ferrule 140, as best seen in FIG. 1.

The outer body 110 may be a connector shell, such as the plug shell illustrated in FIG. 1. The outer body 110 is adapted to receive the insert assembly 120 and the contact members 130. The outer body 110 is preferably made of a metal, such as s copper allow like beryllium copper, leaded-nickel copper, phosphor bronze, or tellurium copper. The outer body 110 is sized such that it may be retrofit into existing connector contact cavities.

Figure 2:
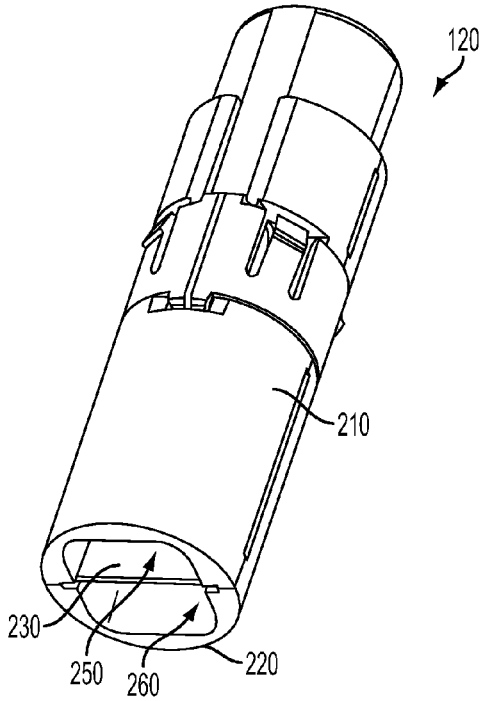
FIG. 2 is a perspective view of an insert assembly of the contact assembly illustrated in FIG. 1.
Figure 3:
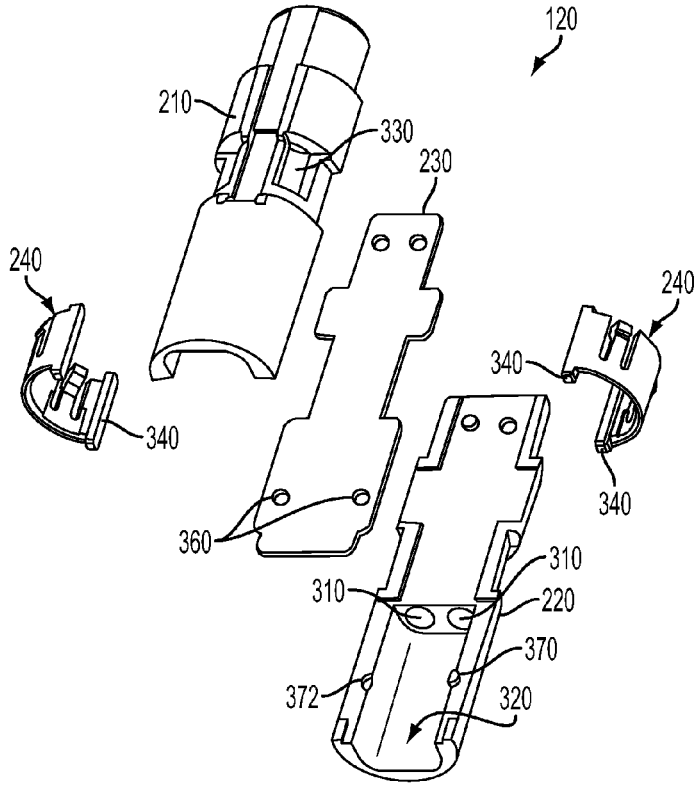
FIG. 3 is an exploded perspective view of the insert assembly illustrated in FIG. 2.

As seen in FIGS. 2 and 3, the insert assembly 120 generally includes a housing defined by first and second insulator halves 210 and 220 and a conductive barrier 230 therebetween. A first receiving area 250 is defined between the first insulator half 210 and the barrier 230; and a second receiving area 260 is defined between the second insulator half 220 and the barrier 230. First and second receiving areas 250 and 260 are adapted to receive the plurality of contact members 130.

Figure 4:
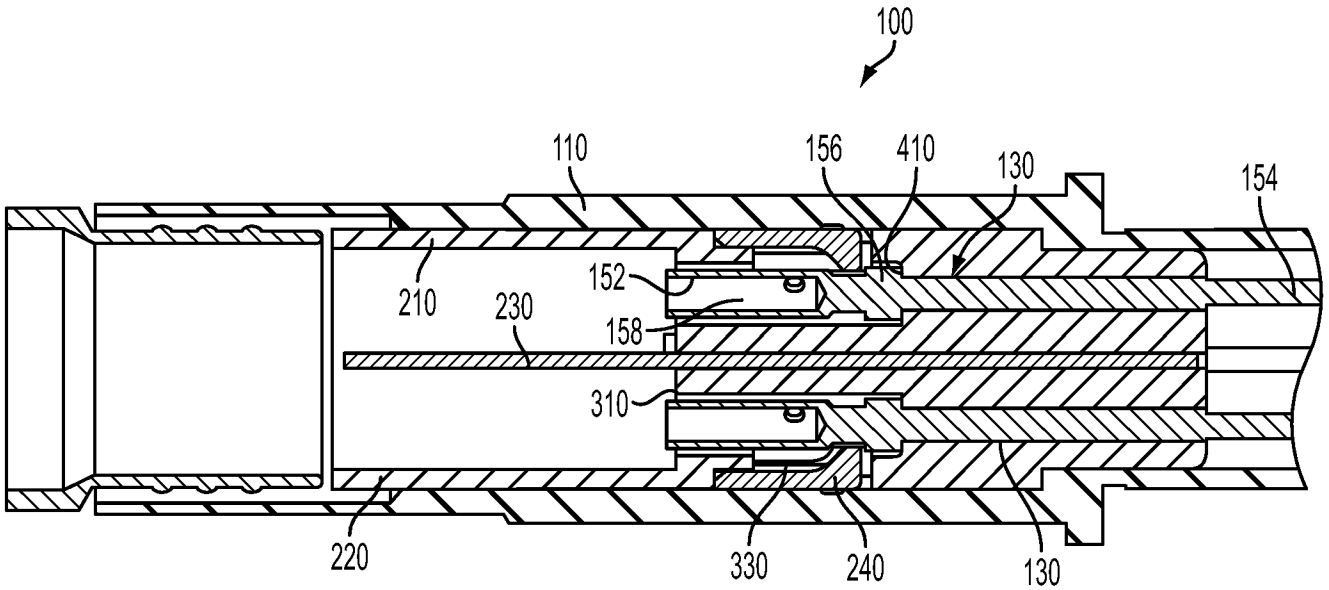
FIG. 4 is a cross-sectional view of the contact assembly illustrated in FIG. 1.
Figure 5:
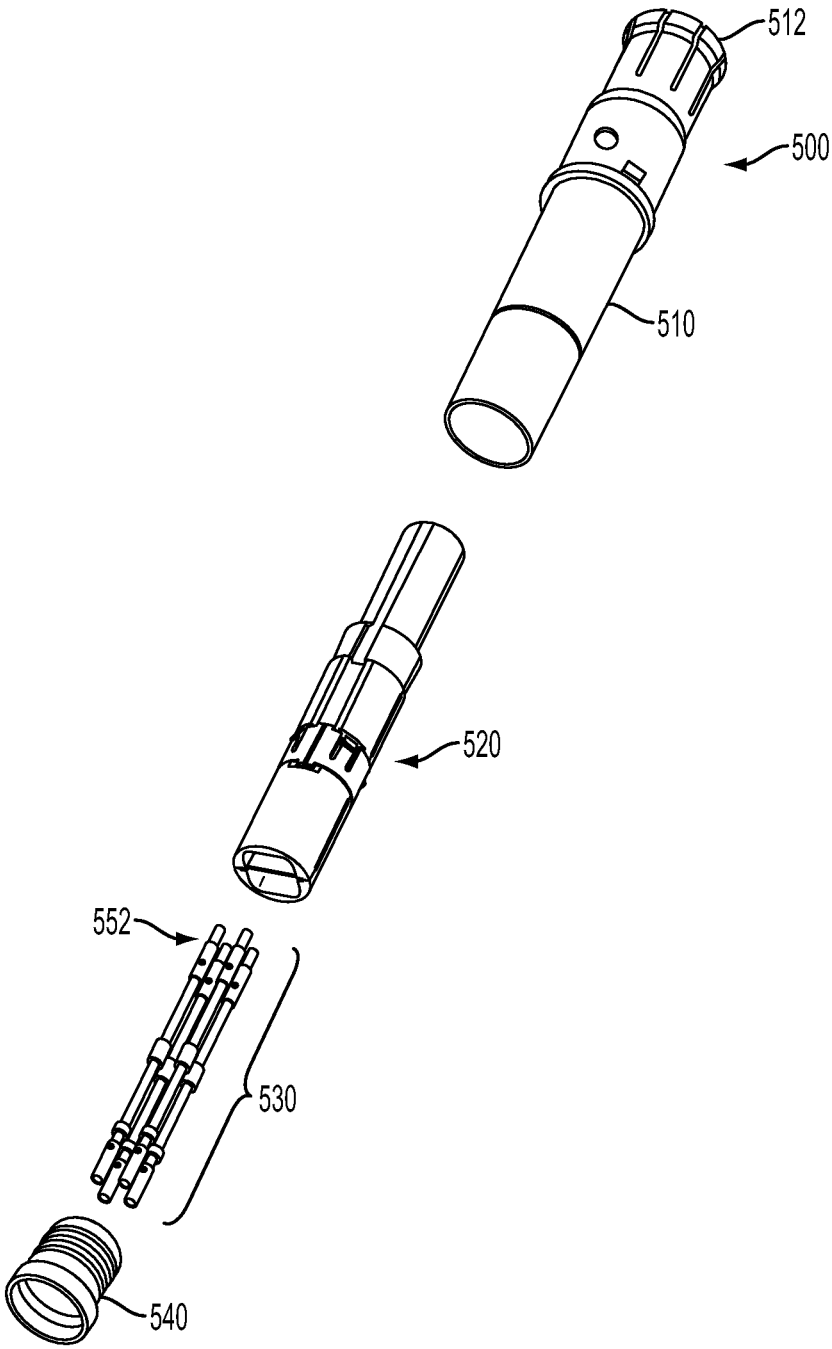
FIG. 5 is an exploded perspective view of a contact assembly according to a second embodiment of the present invention.

As best seen in FIG. 3, the first and second insulator halves 210 and 220 of the housing are substantially identical. They are made of any insulating material. Each insulator half includes two inner portions. The first inner portion has at least one inner bore and preferably first and second inner bores 310 that are sized and shaped to accept individual contact members 130. The second portion forms a cavity 320 adjacent the inner bores 310 that accepts the conductors (not shown) of a cable to be terminated by the contact assembly 100. Each of the insulator halves 210 and 220 also includes an outer open area 330 for accepting ends 340 of retaining clips 240, as seen in FIGS. 3 and 4, for coupling the insulator halves 210 and 220 together. In addition to securing the halves 210 and 220, the retaining clips 240 serve to hold the inner contact members 130 in place, thereby retaining them in the housing. That is, when the contact members 130 mate with corresponding contacts of a mating connector, the retaining clip ends 340 prevent the contacts from pushing back away from the contacts of the mating connector.

The conductive barrier 230 is preferably sandwiched between the first and second insulator halves 210 and 220. Holes 360 may be provided at the ends the bather 230 which correspond to inner detents 370 and notches 372 of the halves 210 and 220 for securing the barrier 230 therebetween. Alternatively, the barrier 230 can be simply sandwiched between the two halves 210 and 220 and/or an adhesive may be used to further secure the bather 230. The barrier 230 may be sized and shape, that is in length and width, to generally match the size and shape of the two halves 210 and 220, as seen in FIG. 3.

The plurality of contact members 130 are preferably grouped in pairs with a first pair of contact members being adapted for insertion into the first receiving area 250 of the insert assembly 120 and the second pair of contact members being adapted for insertion into the second receiving area 260. As best seen in FIGS. 1 and 4, each contact member 130 generally includes an open receiving end 152, a contact end 154, and a shoulder 156 therebetween. The open receiving end 152 includes a cavity 158 that is configured to accept a prepared end of a conductor. The end of the conductor may be prepared in a manner that is well known in the art. The opposite contact end 154 extends through the outer body 110 to an end thereof. The contact ends 154 are preferably exposed at the end of the outer body 110 to form pins. As seen in FIG. 4, each contact member 130 is received in an inner bore 310 of at least one of the insulator halves 210 and 220 of the insert assembly 120. In the inner bore 310, the shoulder 156 of the contact 130 abuts a wall 410 of the inner bore 310, thereby preventing the receiving end 152 of the contact 130 from extending past the wall 410 and through the bore 310.

To assemble the contact assembly 100, the insert assembly 120 is assembled by sandwiching the bather 230 between the first and second insulator halves 210 and 220 of the housing. The retaining clips 240 are then clipped to the outer surfaces of the halves 210 and 220 to secure the halves together. The clips 240 are retained on the insulator halves 210 and 220 by clipping the ends 340 thereof into the outer open areas 330 of each half, as seen in FIG. 4. The ends 340 of retaining clips 240 via the outer open areas 330 retain the inner contact members 130 in place.

The end of the cable is prepared by exposing the ends of its conductors, as is well known in the art. Each conductor is coupled to a respective contact member 130. More specifically, the prepared end of the conductor is inserted and crimped to the receiving end 152 of the contact member 130. Pairs of the contact members 130 with the conductors crimped thereto are then inserted into the first and second receiving areas 250 and 260, respectively, of the insert assembly 120. When in the receiving area, the contacts ends 154 of the contact members 130 are inserted into the inner bores 310 of the insulator halves until the shoulders 156 of the contacts 130 abut the inner wall 410 of the bores 130, as seen in FIG. 4.

The insert assembly 120 with the contacts 130 coupled thereto is then inserted into the outer body 110 such that the contact ends 154 are exposed to form pins. The crimp ferrule 140 is then used to crimp the insert assembly 120 and contacts 130 to the outer body 110.

FIGS. 5-8 illustrate a second exemplary embodiment of the present invention. The contact assembly 500 of the second embodiment differs from the first embodiment in that it is configured to be a socket contact assembly instead of a pin contact assembly. Like the first embodiment, the contact assembly 500 may generally include an outer body 510, an insert assembly 520, a plurality of contacts 530, and a crimp ferrule 540. Unlike the first embodiment, the outer body 510 includes a socket end 512.

Figure 6:
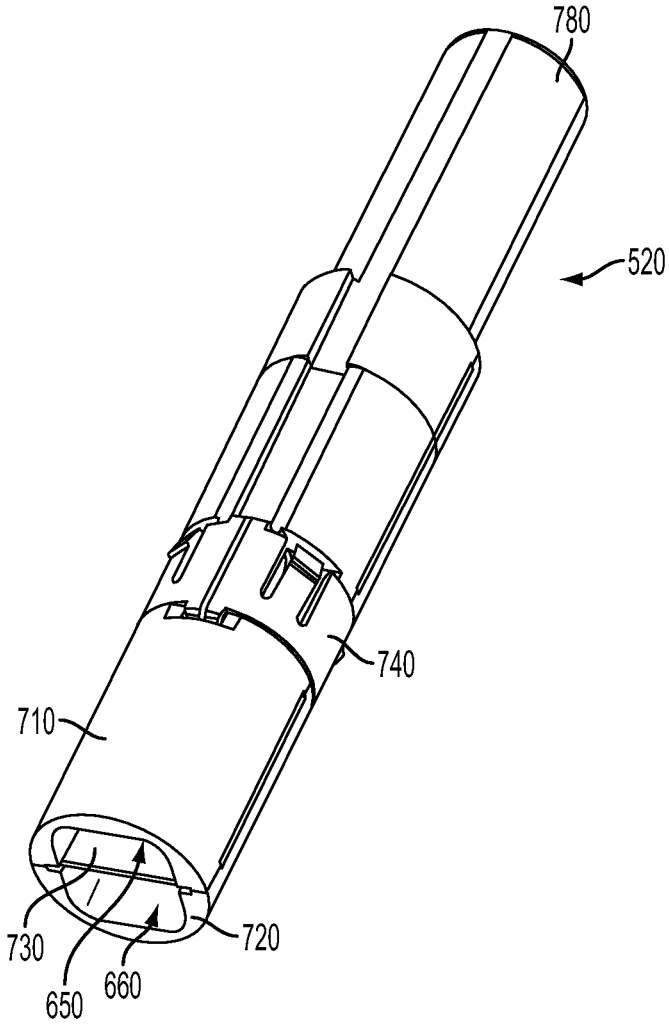
FIG. 6 is a perspective view of an insert assembly of the contact assembly illustrated in FIG. 5.
Figure 7:
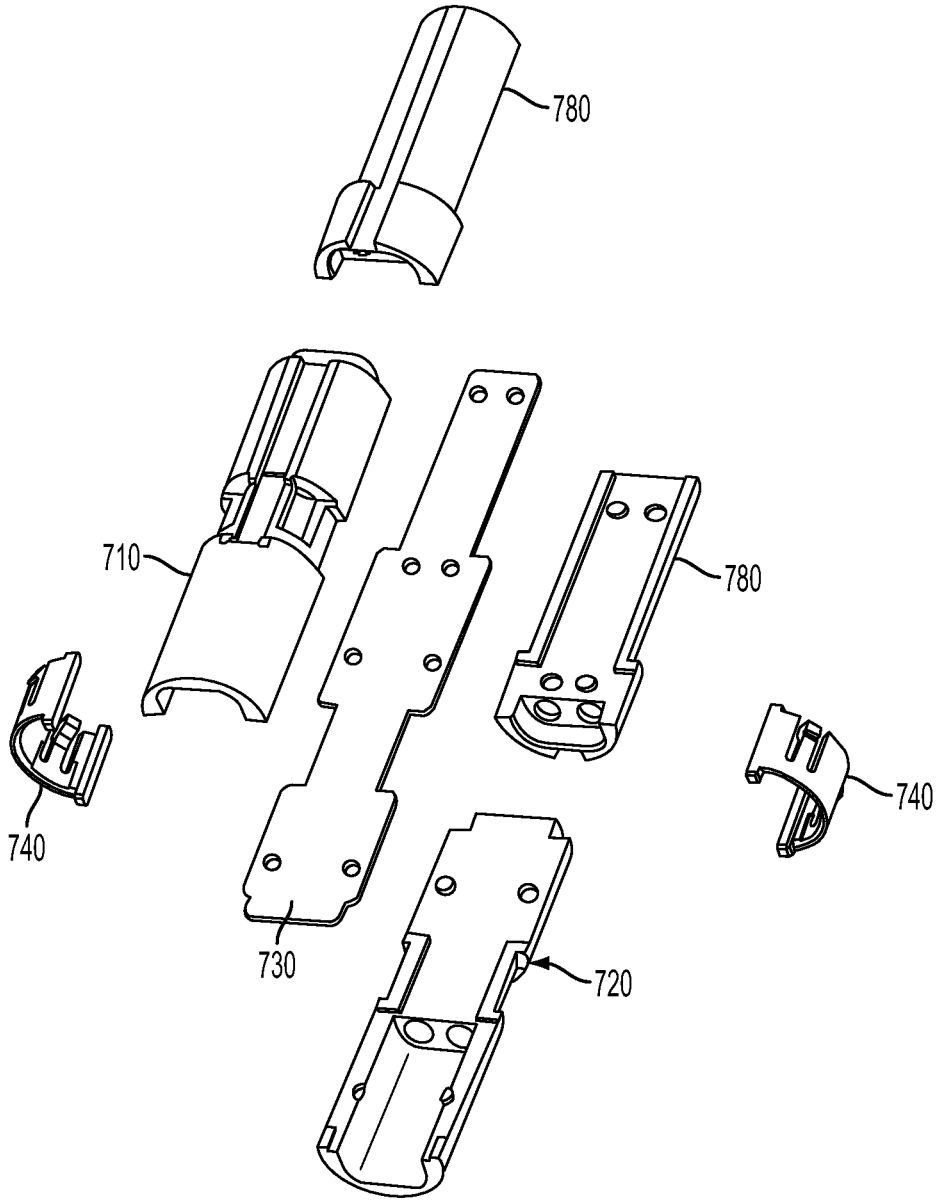
FIG. 7 is an exploded perspective view of the insert assembly illustrated in FIG. 6.
Figure 8:
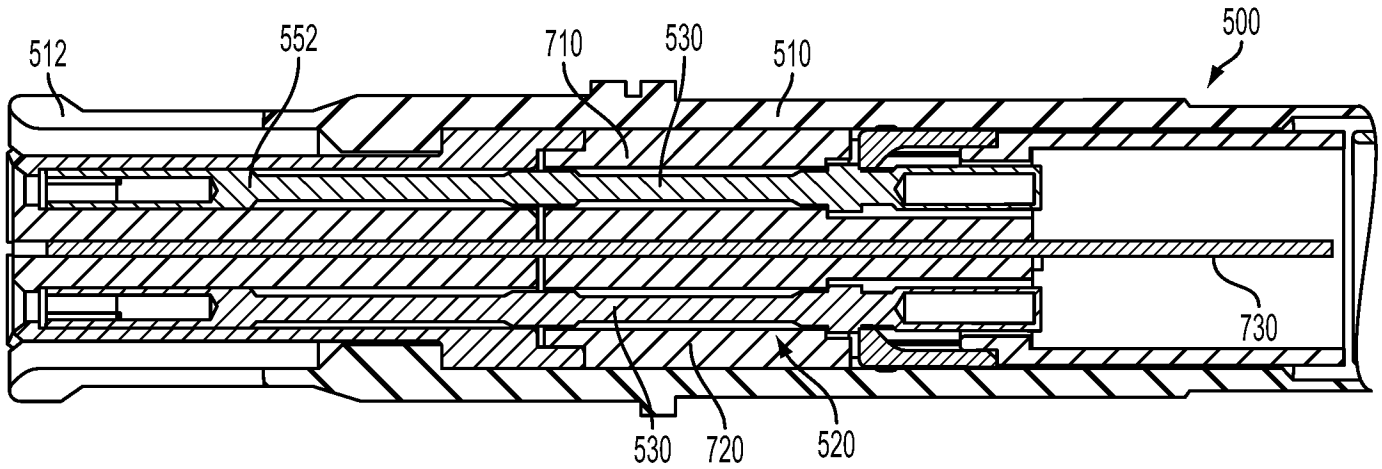
FIG. 8 is a cross-sectional view of the contact assembly illustrated in FIG. 5.

As seen in FIGS. 6 and 7, the insert assembly 520 is similar to the insert assembly 120 in that it generally includes a housing with first and second insulator halves 710 and 720, a conductive barrier 730, and retaining clips 740. The first and second insulator halves 710 and 720 are substantially the same as the first and second halves 210 and 220 of the first embodiment and also define first and second receiving areas 650 and 660.

Unlike the first embodiment, extensions 780 are added to the first and second insulator halves 710 and 720, as seen in FIG. 7. The extensions 780 are added to accommodate the socket contact ends 552 of the contacts 530. Likewise, the barrier 730 of the second embodiment is extended to cover the extensions 780 of the first and second halves 710 and 720. The contact assembly 500 is assembled in substantially the same manner as described above with respect to the contact assembly 100 of the first embodiment.

Figure 9:
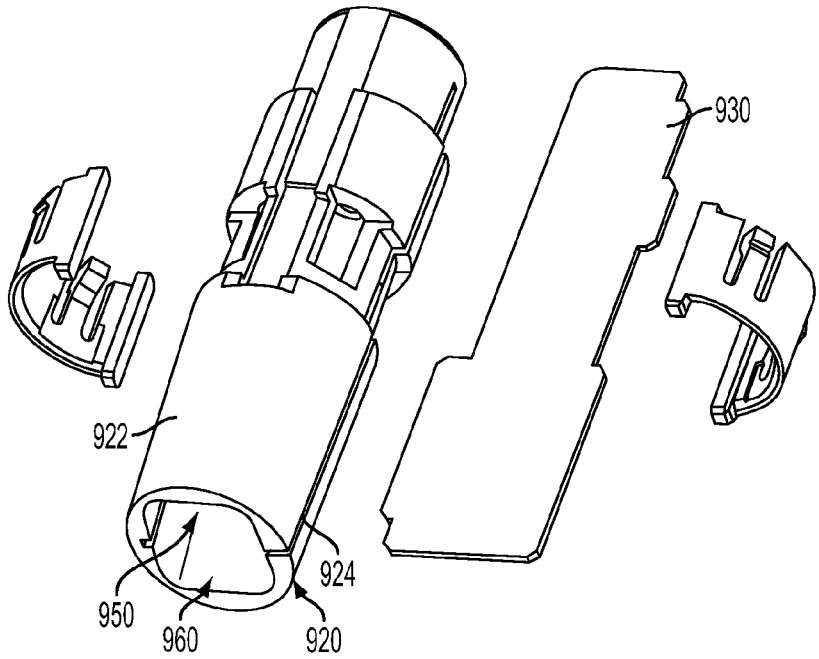
FIG. 9 is an exploded perspective view of an insert assembly according to another exemplary embodiment of the present invention.

FIG. 9 illustrates another exemplary embodiment of an insert assembly 920 for the contact assembly 100. The insert assembly 920 is substantially similar to the insert assembly 120 of the first embodiment, except that the housing 922 of the insert assembly 920 may be formed as a unitary one-piece insulator, instead of two insulator halves. The unitary one-piece housing 922 may have a longitudinal slot 924 that extends between the first and second ends of the housing 922. The slot 924 may be sized and shaped to receive the conductive barrier 930. The conductive barrier 930 may be a plate similar to the barrier 230 of the first embodiment and is shaped in length and width to generally match the length and width of the housing 922. Like the embodiments above, the conductive barrier 930 is received in the housing 922 such that it defines first and second receiving areas 950 and 960 in the housing 922. Each receiving area 950 and 960 may include a cavity and one or more inner bores for receiving one or more contact members 130, like in the first embodiment. The insert assembly 920 is assembled by inserting the barrier 930 through the longitudinal slot 924 until the barrier 930 is received in the housing 922 such that it divides the housing 922 into the two receiving areas 950 and 960. Like the embodiments above, retaining clips may be used to retain the inner contact members in via open areas in the housing. The insert assembly 920 including the one-piece unitary housing 922 may be either a plug contact assembly, like in the first embodiment, or socket contact assembly, like in the second embodiments.

Figure 10:
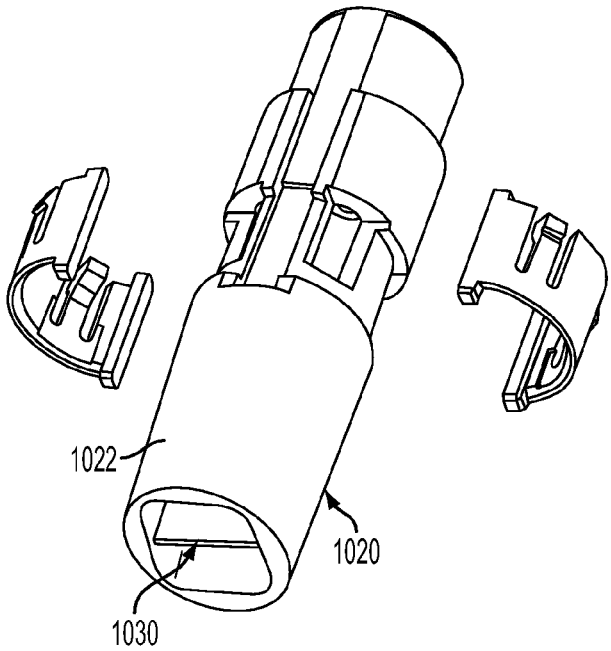
FIG. 10 is an exploded perspective view of an insert assembly according to yet another exemplary embodiment of the present invention.

FIG. 10 illustrates yet another exemplary embodiment of the present. The insert assembly 1020 of this embodiment is similar to the embodiments above, except that the housing 1022 of the insert assembly 1020 is overmolded onto the conductive bather 1030. Because the housing 1022 is an overmold, it is unitary and one-piece. Also, no slot in the housing 1022 is needed because the housing 1022 is overmolded onto to the bather 1030. Retaining clips may be used to retain the inner contact members in place in the same manner described above.

While particular embodiments have been chosen to illustrate the invention, it will be understood by those skilled in the art that various changes and modifications can be made therein without departing from the scope of the invention as defined in the appended claims. For example, although the contact assembly is designed for 2 pairs of conductors, the contact assembly may be design to accommodate any number of contacts including 1 or more pairs of conductors.

What is claimed is:

1. A contact assembly, comprising of:

an outer body;

an insert assembly receivable in said outer body, said insert assembly including a housing and a conductive barrier received in said housing, said conductive barrier defines first and second receiving areas in said housing, each of said first and second receiving areas having a first portion that includes at least one enclosed inner bore and a second portion that forms an open cavity;

at least a first contact member receivable in said first receiving area, and a portion of said first contact abuts a wall of said at least one enclosed inner bore of said first receiving area, said wall being adjacent to said open cavity; and at least a second contact member receivable in said second receiving area, and a portion of said second contact abuts a wall of said at least one enclosed inner bore of said second receiving area, said wall being adjacent to said open cavity, whereby each of said first and second contact members being adapted to accept a conductor.

2. A contact assembly according to claim 1, wherein said insert assembly includes first and second insulator halves;

said first receiving area is defined between said first insulator half and said barrier;

and said second receiving area is defined between said second insulator half and said barrier.

3. A contact assembly according to claim 2, wherein at least one retaining clip is disposed on said first and second insulator halves for coupling the first and second insulator halves together.

4. A contact assembly according to claim 3, wherein each of said first and second insulator halves has an outer open area for receiving a portion of said at least one retaining clip for retaining said first and second contact members in place.

5. A contact assembly according to claim 1, wherein each of said first and second receiving areas including a cavity and at least one inner bore for receiving said first and second contact members, respectively.

6. A contact assembly according to claim 1, wherein each of said first and second contact members includes a receiving end adapted to couple to a conductor and an opposite contact end.

7. A contact assembly according to claim 6, wherein a shoulder is disposed between said receiving end and said contact end of each of said first and second contact members.

8. A contact assembly, comprising of:

an outer body;

an insert assembly receivable in said outer body, said insert assembly having a housing consisting of first and second identical insulator halves, and a single conductive barrier disposed between said first and second identical halves, said conductive barrier defining first and second receiving areas in said housing;

at least one contact member receivable in said first receiving area, said at least one contact member being adapted to receive a conductor; and at least one contact member receivable in said second receiving area, said at least one contact member being adapted to receive a conductor.

9. A contact assembly according to claim 8, wherein said first receiving area includes a cavity and at least one inner bore for receiving said at least one contact member; and said second receiving area includes a cavity and at least one inner bore for receiving said at least one contact member.

10. A contact assembly according to claim 8, wherein said first receiving area receives a first pair of substantially identical contact members, each of said contact members of said first pair of substantially identical contact members is adapted to receive a conductor; and said second receiving area receives a second pair of substantially identical contact members, each of said contact member of said second pair of substantially identical contact members is adapted to receive a conductor.

11. A contact assembly according to claim 10, wherein said first receiving area includes a cavity and a pair of inner bores for receiving said first pair of contact members; and said second receiving area includes a cavity and a pair of inner bores for receiving said second pair of contact members.

12. A contact assembly according to claim 8, wherein the outer body is a plug shell.

13. A contact assembly according to claim 8, wherein the outer body is a socket shell.

14. A contact assembly according to claim 8, wherein each contact member includes a receiving end adapted to couple to said conductor and an opposite contact end.

15. A contact assembly according to claim 14, wherein a shoulder is disposed between said receiving end and said contact end of each of said contact members.

16. A contact assembly according to claim 8, wherein at least one retaining clip is disposed on said first and second insulator halves for coupling the first and second insulator halves together.

17. A contact assembly according to claim 16, wherein each of said first and second insulator halves has an outer open area for receiving a portion of said at least one retaining clip for retaining said contact members in place.

18. A contact assembly, comprising of:

an outer body;

an insert assembly receivable in said outer body, said insert assembly including a unitary one-piece housing with a first end and a second end opposite said first end, a conductive barrier receivable in said housing, said conductive barrier defining first and second receiving areas in said housing, each of said first and second receiving areas having a first portion that includes at least one enclosed inner bore and a second portion that forms an open cavity;

at least a first contact member receivable in said first receiving area of said housing, and a portion of said first contact abuts a wall of said at least one enclosed inner bore of said first receiving area, said wall being adjacent to said open cavity; and at least a second contact member receivable in said second receiving area of said housing, and a portion of said second contact abuts a wall of said at least one enclosed inner bore of said second receiving area, said wall being adjacent to said open cavity, wherein each of said first and second contact members being adapted to accept a conductor.

19. A contact assembly according to claim 18, wherein a longitudinal slot extends between said first and second ends of said housing for receiving said conductive barrier.

20. A contact assembly according to claim 18, wherein said housing is overmolded on said conductive bather.

21. A contact assembly according to claim 18, wherein each of said first and second receiving areas includes a cavity and at least one bore for receiving said first and second contact members, respectively.

22. A contact assembly according to claim 18, wherein each of said first and second contact members includes a receiving end for receiving said conductor, an opposite contact end, and a shoulder between said receiving end and said contact end.

23. A contact assembly according to claim 18, further comprising at least one retaining clip disposed on said first and second insulator halves, and each of said first and second insulator halves has an outer open area for receiving a portion of said at least one retaining clip for retaining said contact members in place.

24. A contact assembly according to claim 8, wherein each of said first and second receiving areas having a first portion that includes at least one enclosed inner bore and a second portion that forms an open cavity;

said at least one contact member receivable in said first receiving area has a portion that abuts a wall of said at least one enclosed inner bore of said first receiving area, said wall being adjacent to said open cavity; and said at least one contact member receivable in said second receiving area has a portion that abuts a wall of said at least one enclosed inner bore of said second receiving area, said wall being adjacent to said open cavity.

* * * * *